US009656385B1

(12) United States Patent
Kao

(10) Patent No.: US 9,656,385 B1
(45) Date of Patent: May 23, 2017

(54) HAND TOOL FRAME

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 15/084,471

(22) Filed: Mar. 29, 2016

(51) Int. Cl.
*A47F 7/00* (2006.01)
*B25H 3/04* (2006.01)

(52) U.S. Cl.
CPC ..... *B25H 3/04* (2013.01); *A47F 7/0035* (2013.01)

(58) Field of Classification Search
CPC .... A47F 7/0021; A47F 7/0028; A47F 7/0035; A47F 5/0846; A47F 5/0838; A47F 5/0853; A47F 5/10; A47F 2001/103; B25H 3/003; B25H 3/06; B25B 13/56; A47B 96/067; A47B 45/00; A47G 21/14
USPC ..... 211/70.6, 94.01, 69, 57.1, 59.1, 175, 211/70.8, 60.1; 206/349, 372–379
See application file for complete search history.

(56) References Cited

U.S. PATENT DOCUMENTS 4,768,660 A * 9/1988 Handler ..... B25H 3/04 211/106.01
5,855,274 A * 1/1999 Piao ..... B25H 3/04 206/373
6,698,600 B1 * 3/2004 Lee ..... B25H 3/003 206/378
7,108,132 B2 * 9/2006 Shih ..... B25H 3/003 206/378
7,669,723 B2 * 3/2010 Kao ..... B25H 3/04 206/349
7,717,278 B2 * 5/2010 Kao ..... B25H 3/04 206/349
8,403,155 B1 * 3/2013 Kao ..... B25H 3/04 206/376
9,186,790 B1 * 11/2015 Kao ..... B25H 3/06
9,522,467 B1 * 12/2016 Kao ..... A47F 7/0028
9,539,721 B1 * 1/2017 Kao ..... B25H 3/003
9,591,931 B1 * 3/2017 Oren ..... A47B 96/1433
2001/0001197 A1 * 5/2001 Ramsey ..... B25H 3/06 206/378
2001/0010291 A1 * 8/2001 Hu ..... B25H 3/003 206/377
2006/0207951 A1 * 9/2006 Wang ..... A47F 7/024 211/70.6
2008/0156754 A1 * 7/2008 Cheng ..... B25H 3/04 211/70.6
2009/0134288 A1 * 5/2009 Kao ..... B25H 3/04 248/214

(Continued)

*Primary Examiner* — Jennifer E Novosad
(74) *Attorney, Agent, or Firm* — Hershkovitz & Associates, PLLC; Abe Herchkovitz

(57) ABSTRACT

A hand tool frame has a track base, a positioning board, and at least one positioning mount. The track base has a bottom panel and a slide rail. The positioning board is mounted in the track base and has multiple engaging holes formed through the positioning board. The at least one positioning mount is slidably mounted on the track base and has a sliding seat and an extending element. The sliding seat is slidably mounted in the slide rail and has a body, a positioning portion, and an engaging protrusion. The engaging protrusion is formed on and protrudes from the positioning portion, and selectively engages with one of the engaging holes to enable the sliding seat to securely mount on the positioning board without sliding relative to the track base. The extending element is formed on and protrudes from the sliding seat.

10 Claims, 12 Drawing Sheets

(56) References Cited

U.S. PATENT DOCUMENTS

| | | | | |
|---|---|---|---|---|
| 2009/0218302 | A1* | 9/2009 | Winnard | B25H 3/003 211/70.6 |
| 2011/0192810 | A1* | 8/2011 | Kao | B25H 3/028 211/70.6 |
| 2012/0061339 | A1* | 3/2012 | Chang | A47F 5/0006 211/70.6 |
| 2015/0202767 | A1* | 7/2015 | Kao | F16M 13/022 211/70.6 |
| 2016/0031074 | A1* | 2/2016 | Su | B25H 3/04 206/378 |
| 2016/0221178 | A1* | 8/2016 | Hsieh | B25H 3/04 |
| 2017/0049250 | A1* | 2/2017 | Oren | A47B 96/1433 |

* cited by examiner

HAND TOOL FRAME

BACKGROUND OF THE INVENTION

1. Field of the Invention

The present invention relates to a hand tool frame, and more particularly to a hand tool frame that may provide a positioning effect to hand tools that are mounted on the hand tool frame and may provide a stable clamping effect to the hand tools.

2. Description of Related Art

A conventional hand tool frame is used to clamp and store hand tools, and has a track base and multiple positioning mounts. The track base is an elongated seat and has a top side and a slide rail. The slide rail is formed in the top side of the track base. The positioning mounts are slidably mounted in the slide rail of the track base, and each one of the positioning mounts has a sliding seat and an extending element. The sliding seat is slidably mounted in the slide rail of the track base and has a top surface. The extending element is formed on and protrudes from the top surface of the sliding seat and extends out of the slide rail. Then, hand tools such as sleeves, wrenches or screwdrivers may be securely mounted on or clamped between the extending elements of the positioning mounts to store the hand tools on the track base of the conventional hand tool frame.

Though the conventional hand tool frame may provide a storage-clamping effect to the hand tools, the sliding seats of the positioning mounts lack engaging structures relative to the slide rail of the track base to hold or clamp the hand tools securely on the track base at specific positions. When the conventional hand tool frame is moved or someone hits the hand tools that are stored on the track base of the conventional hand tool frame, the positions of the hand tools that are mounted on the positioning mounts may be changed, and the hand tools that are clamped between the positioning mounts may be separated from the positioning mounts. Then, the hand tools cannot be securely mounted on the positioning mounts at fixed positions or cannot be securely clamped between the positioning mounts, and a user needs to adjust the positions of the hand tools after moving the conventional hand tool frame, and the hand tools may be separated from the positioning mounts and injure the users.

To overcome the shortcomings, the present invention tends to provide a hand tool frame to mitigate the aforementioned problems.

SUMMARY OF THE INVENTION

The main objective of the invention is to provide a hand tool frame that may provide a positioning effect to hand tools that are mounted on the hand tool frame and may provide a stable clamping effect to the hand tools.

A hand tool frame in accordance with the present invention has a track base, a positioning board, and at least one positioning mount. The track base has a bottom panel and a slide rail. The positioning board is mounted in the track base and has multiple engaging holes formed through the positioning board. The at least one positioning mount is slidably mounted on the track base and has a sliding seat and an extending element. The sliding seat is slidably mounted in the slide rail and has a body, a positioning portion, and an engaging protrusion. The engaging protrusion is formed on and protrudes from the positioning portion, and selectively engages with one of the engaging holes to enable the sliding seat to securely mount on the positioning board without sliding relative to the track base. The extending element is formed on and protrudes from the sliding seat.

Other objects, advantages and novel features of the invention will become more apparent from the following detailed description when taken in conjunction with the accompanying drawings.

DETAILED DESCRIPTION OF PREFERRED EMBODIMENT

Figure 1:
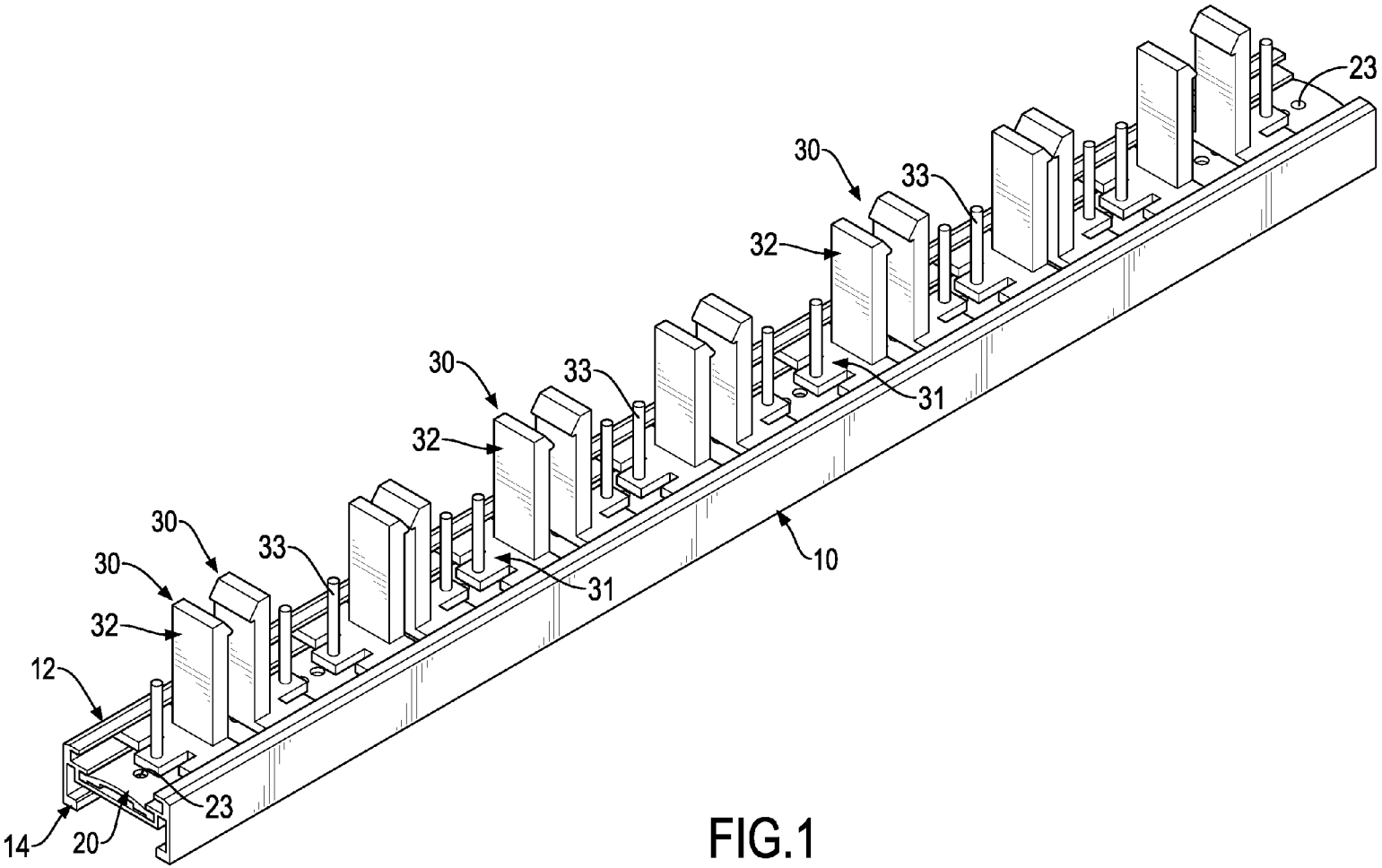
FIG. 1 is a perspective view of a first embodiment of a hand tool frame in accordance with the present invention.
Figure 2:
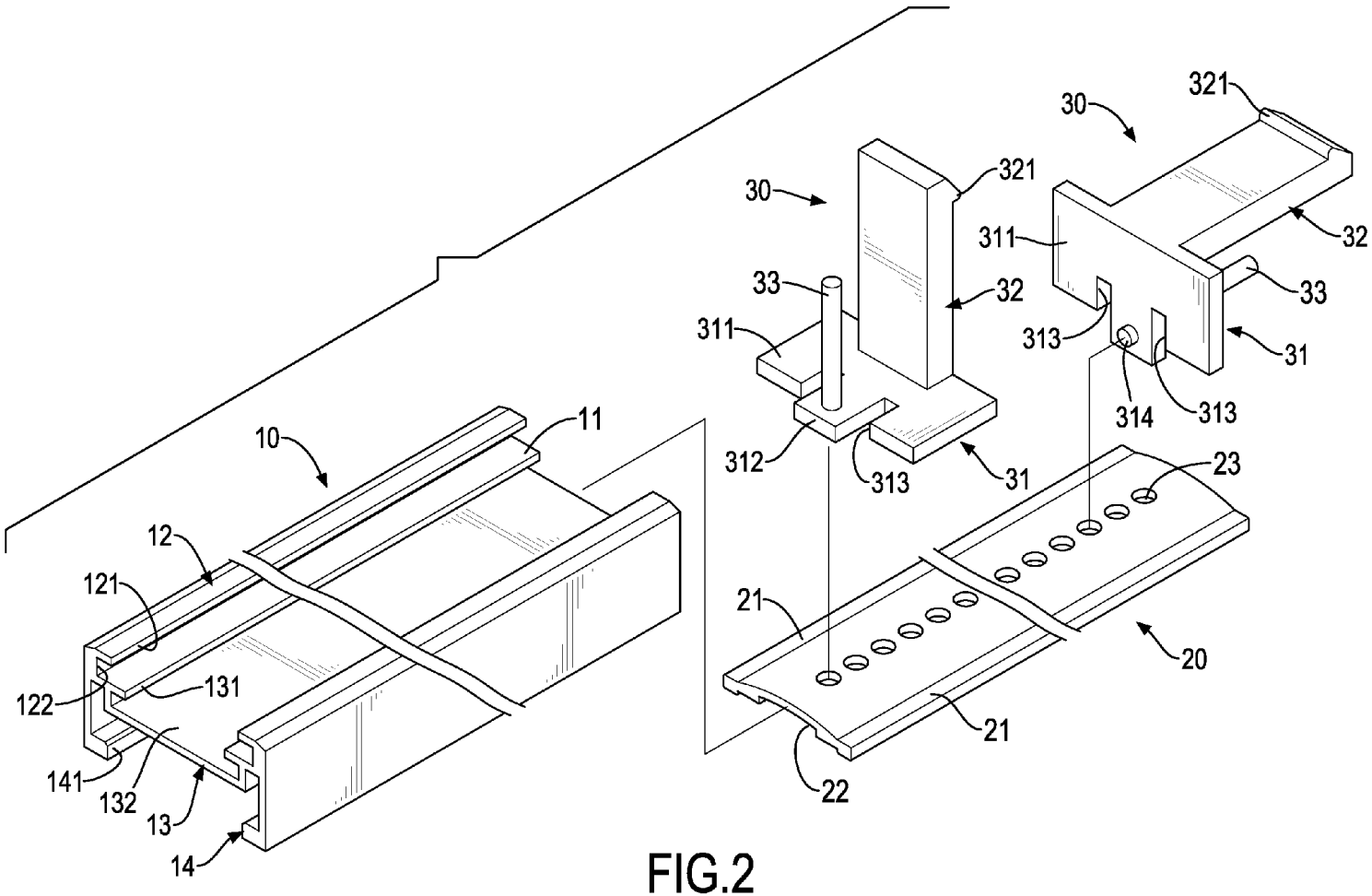
FIG. 2 is an enlarged and exploded perspective view of the hand tool frame in FIG. 1.
Figure 3:
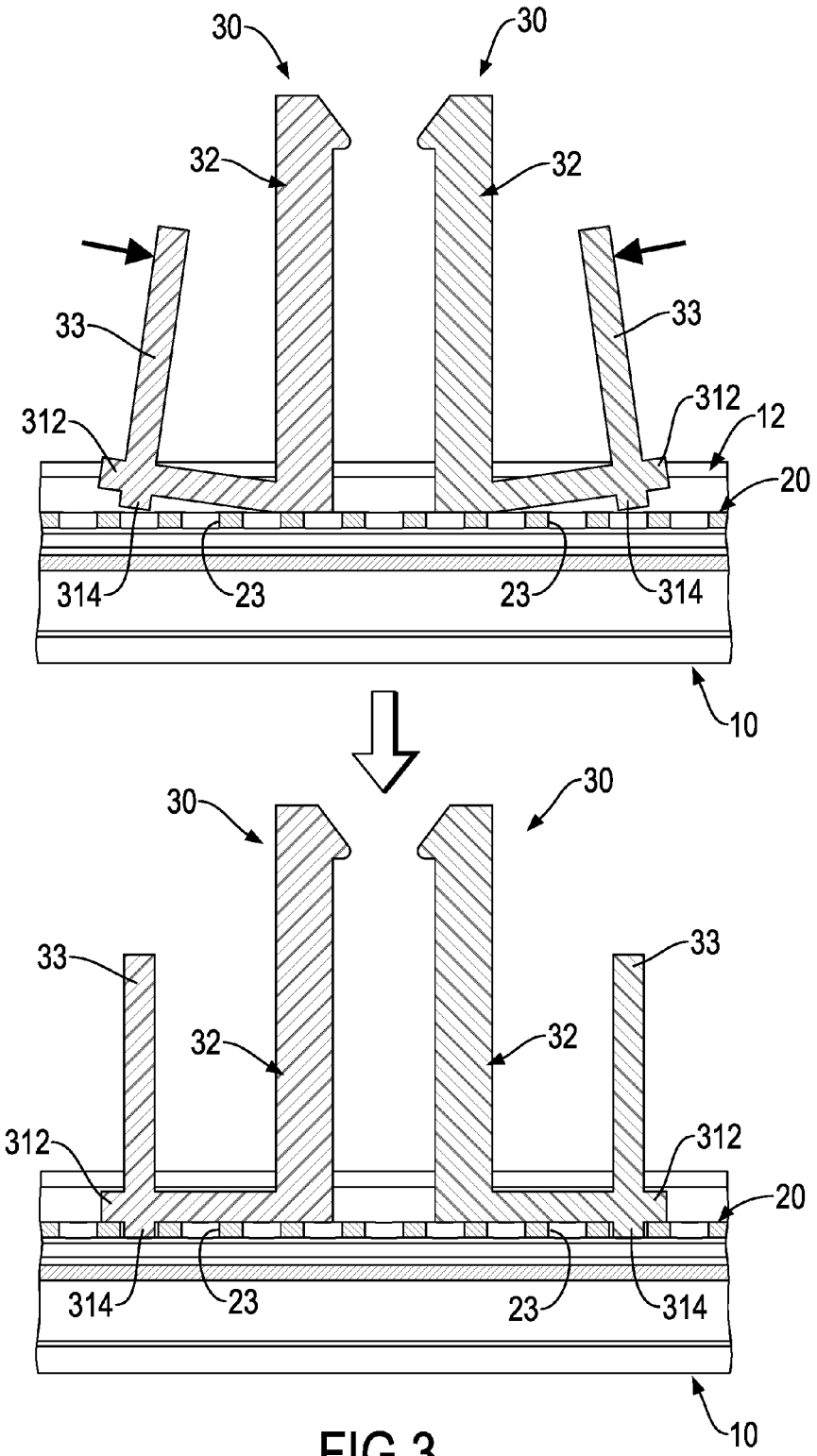
FIG. 3 is an operational and enlarged cross sectional side view of the hand tool frame in FIG. 1.

With reference to FIGS. 1 to 3, a first embodiment of a hand tool frame in accordance with the present invention comprises a track base 10, a positioning board 20, and at least one pair of positioning mounts 30.

The track base 10 may be made of aluminum, is an elongated seat and has a bottom panel 11, a slide rail 12, a connecting track 13, and a closed track 14. The bottom panel 11 is elongated and has a top surface, a bottom surface, a front end, and a rear end. The slide rail 12 is formed on and protrudes upwardly from the top surface of the bottom panel 11 between the front end and the rear end of the bottom panel 11 and has a top side, a top opening 121, and a sliding recess 122. The top opening 121 is formed through the top side of the slide rail 12. The sliding recess 122 is formed in the slide rail 12 between the top side of the slide rail 12 and the top surface of the bottom panel 11 and communicates with the top opening 121.

The connecting track 13 is formed on and protrudes downwardly from the bottom surface of the bottom panel 11, and has a top side, a communicating opening 131, and a connecting recess 132. The top side of the connecting track 13 is formed on and protrudes from the bottom surface of the bottom panel 11. The communicating opening 131 is formed through the top side of the connecting track 13 and the bottom surface of the bottom panel 11, and communicates with the sliding recess 122 of the slide rail 12. The connecting recess 132 is formed between the bottom panel 11 and the connecting track 13 and communicates with the communicating opening 131. Additionally, a width of the communicating opening 131 of the connecting track 13 is narrower than a width of the top opening 121 of the slide rail 12.

The closed track 14 is formed on and protrudes downwardly from the bottom surface of the bottom panel 11 around the connecting track 13 and has a bottom side and a bottom opening 141 formed through the bottom side of the closed track 14. In addition, the closed track 14 and the slide rail 12 are formed on the bottom panel 11 as a single piece.

The positioning board 20 is elastic, is mounted in the connecting track 13 of the track base 10 and has two long opposite sides, a front end, a rear end, a middle, a top surface, a bottom surface, two rail bars 21, a through recess 22, and multiple engaging holes 23. The positioning board 20 is bent upwardly from the long opposite sides of the positioning board 20 to the middle of the positioning board 20. Then, the top surface of the positioning board 20 at the middle of the positioning board 20 extends at the communicating opening 131 of the connecting track 13.

The rail bars 21 are formed on and protrude downwardly from the bottom surface of the positioning board 20 respectively at the two long opposite sides of the positioning board 20 and are mounted in the connecting recess 132 of the connecting track 13.

The through recess 22 is formed in the bottom surface of the positioning board 20 at the middle of the positioning board 20 between the front end and the rear end of the positioning board 20, is parallel with the long opposite sides of the positioning board 20 and communicates with the connecting recess 132 of the connecting track 13. Then, a space is formed between the connecting track 13 and the middle of the positioning board 20, and the space may allow the middle of the positioning board 20 to deform relative to the track base 10.

The engaging holes 23 are formed through the top surface and the bottom surface of the positioning board 20 at the middle of the positioning board 20, communicate with the connecting recess 132 of the connecting track 13 via the through recess 22 and communicate with the sliding recess 122 of the slide rail 12 via the communicating opening 131 of the connecting track 13.

The at least one pair of positioning mounts 30 are slidably mounted on the track base 10, and each one of the at least one pair of positioning mounts 30 has a sliding seat 31, an extending element 32, and a pressing arm 33.

The sliding seat 31 is slidably mounted in the sliding recess 122 of the slide rail 12 and abuts the positioning board 20. The sliding seat 31 has a body 311, a positioning portion 312, two through slots 313, and an engaging protrusion 314. The body 311 is U-shaped, is slidably mounted in the sliding recess 122 of the slide rail 12 and has a bottom side, a top side, two free ends, and a middle. The bottom side of the body 311 faces the communicating opening 131 of the connecting track 13 and abuts the top surface of the positioning board 20. The top side of the body 311 faces the top opening 121 of the slide rail 12. The middle of the body 311 is formed between the two free ends of the body 311.

The positioning portion 312 is elastic, is formed on and protrudes transversally from the middle of the body 311, and has a bottom surface and a top surface. The bottom surface of the positioning portion 312 abuts the top surface of the positioning board 20. The through slots 313 are respectively formed through the body 311 between the free ends of the body 311 and the positioning portion 312, and this makes the positioning portion 312 elastomeric relative to the body 311. Then, the positioning portion 312 of the sliding seat 31 may be deformed to separate from the top surface of the positioning board 20.

The engaging protrusion 314 is formed on and protrudes downwardly from the bottom surface of the positioning portion 312, and selectively engages with one of the engaging holes 23 of the positioning board 20. Then, the sliding seat 31 may be securely mounted on the positioning board 20 without sliding relative to the track base 10 by the engagement between the engaging protrusion 314 and a corresponding engaging hole 23 of the positioning board 20.

The extending element 32 is formed on and protrudes upwardly from the sliding seat 31 and extends out of the slide rail 12 via the top opening 121. The extending element 32 is used to clamp a hand tool. Furthermore, in the first embodiment of the hand tool frame, the extending element 32 of each one of the at least one pair of positioning mounts 30 is a clamping arm and is formed on the top side of the body 311 of the sliding seat 31 and has a free end, an inner side, an outer side, and a holding hook 321. The free end of the extending element 32 extends out of the slide rail 12 via the top opening 121. The inner sides of the extending elements 32 of the at least one pair of positioning mounts 30 face to each other. The outer side of the extending element 32 is opposite to the inner side of the extending element 32. The holding hook 321 is formed on and protrudes from the inner side of the extending element 32 at the free end of the extending element 32. The holding hooks 321 of the at least one pair of positioning mounts 30 face to each other, and a holding space is formed between the extending elements 32 of the at least one pair of positioning mounts 30.

The pressing arm 33 is formed on and protrudes upwardly from the bottom side of the body 311 of the sliding seat 31 and has an upper end extending out of the slide rail 12 via the top opening 121.

With reference to FIG. 3, when the hand tool frame of the first embodiment in the present invention is in use, the holding space between the extending elements 32 of the at least one pair of positioning mounts 30 may be adjusted by pressing the pressing arms 33 respectively toward the extending elements 32 of the at least one pair of positioning mounts 30 to enable the two engaging protrusions 314 of the sliding seats 31 to respectively disengage from two corresponding engaging holes 23 of the positioning board 20. Then, the sliding seats 31 of the at least one pair of positioning mounts 30 may be pushed to slide along the positioning board 20 relative to the track base 10. After the holding space between the at least one pair of positioning mounts 30 is adjusted, the at least one pair of positioning mounts 30 may be positioned on the positioning board 20 by the engagement between the engaging protrusions 314 and two corresponding engaging holes 23.

Figure 4:
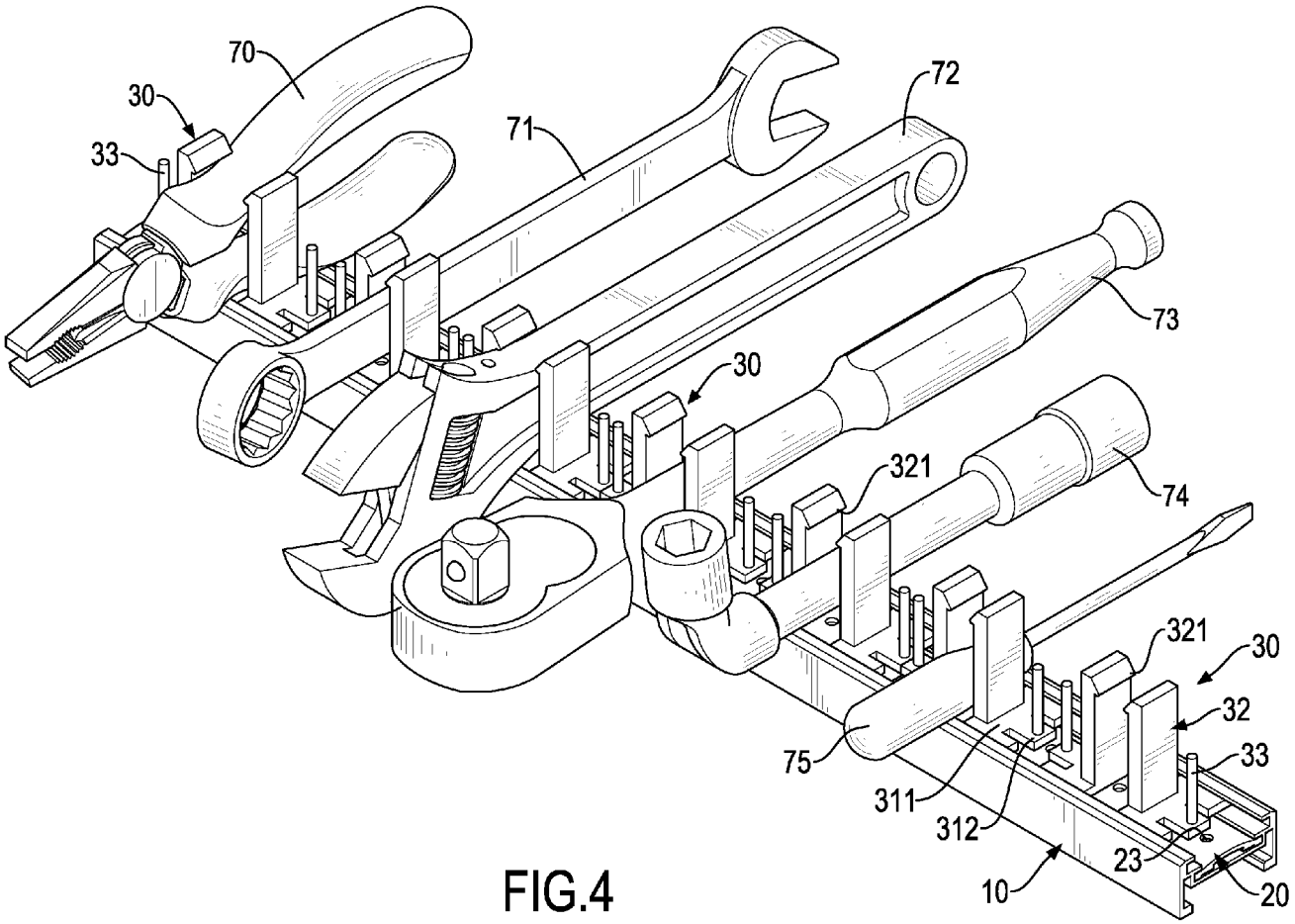
FIG. 4 is an enlarged operational perspective view of the hand tool frame in FIG. 1, shown with forceps, wrenches and screwdrivers mounted on the hand tool frame.

With reference to FIG. 4, different kinds of hand tools such as pliers 70, combination spanners 71, adjustable wrenches 72, socket wrenches 73, hexagonal wrenches 74 or screwdrivers 75 may be inserted into the holding space that is formed between the extending elements 32 of the at least one pair of positioning mounts 30, and the holding hooks 321 securely clamp the hand tools to prevent the hand tools separating from the at least one pair of positioning mounts 30. When the hand tool frame of the first embodiment in the present invention is moved or someone hits the hand tools that are stored on the track base 10, the hand tools are still securely clamped between the positioning mounts 30 without changing positions or separating from the positioning mounts 30. Then, the user doesn't need to adjust the positions of the hand tools after moving the hand tool frame, and the hand tools are securely clamped between the positioning mounts 30 and will not injure the users.

Figure 5:
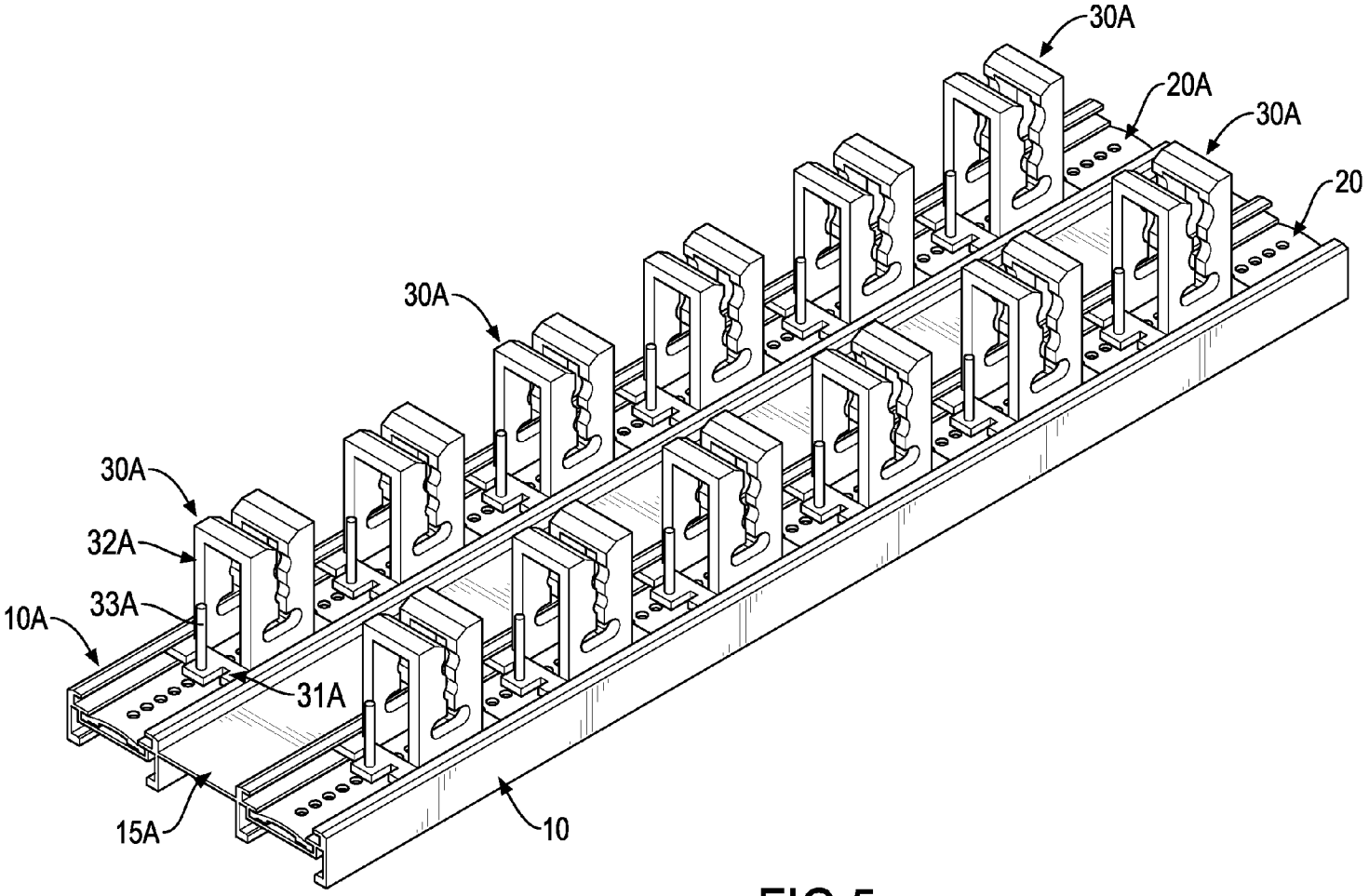
FIG. 5 is a perspective view of a second embodiment of a hand tool frame in accordance with the present invention.
Figure 6:
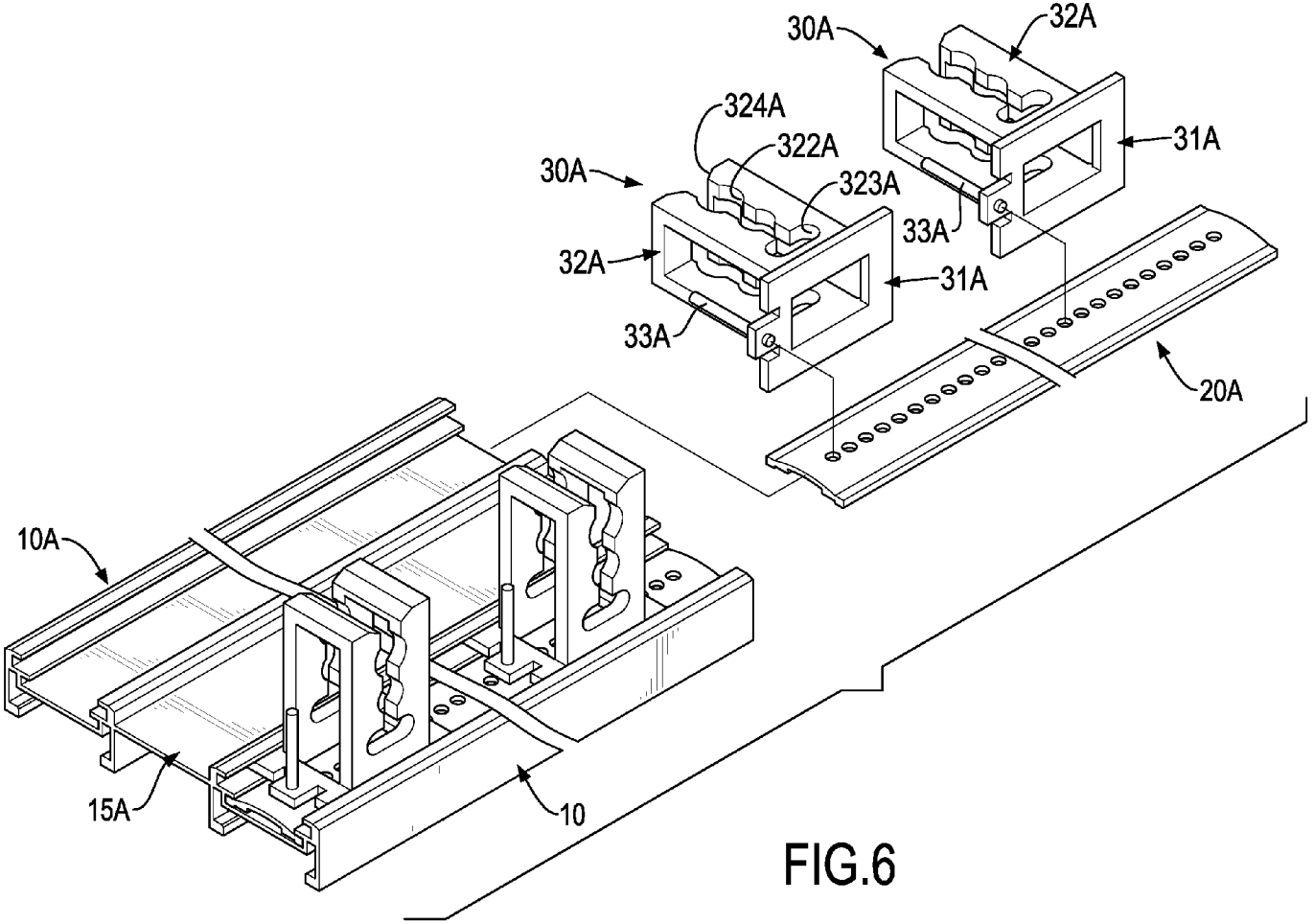
FIG. 6 is an enlarged and exploded perspective view of the hand tool frame in FIG. 5.

With reference to FIGS. 5 and 6, a second embodiment of a hand tool frame in accordance with the present invention is substantially the same as the first embodiment except for the following features. The hand tool frame further has an extending track base 10A and an additional positioning board 20A. The extending track base 10A is connected to and parallel with the track base 10 by an extending panel 15A. The additional positioning board 20A is mounted in the extending track base 10A, and the structure of the additional positioning board 20A is substantially the same as the positioning board 20.

Figure 8:
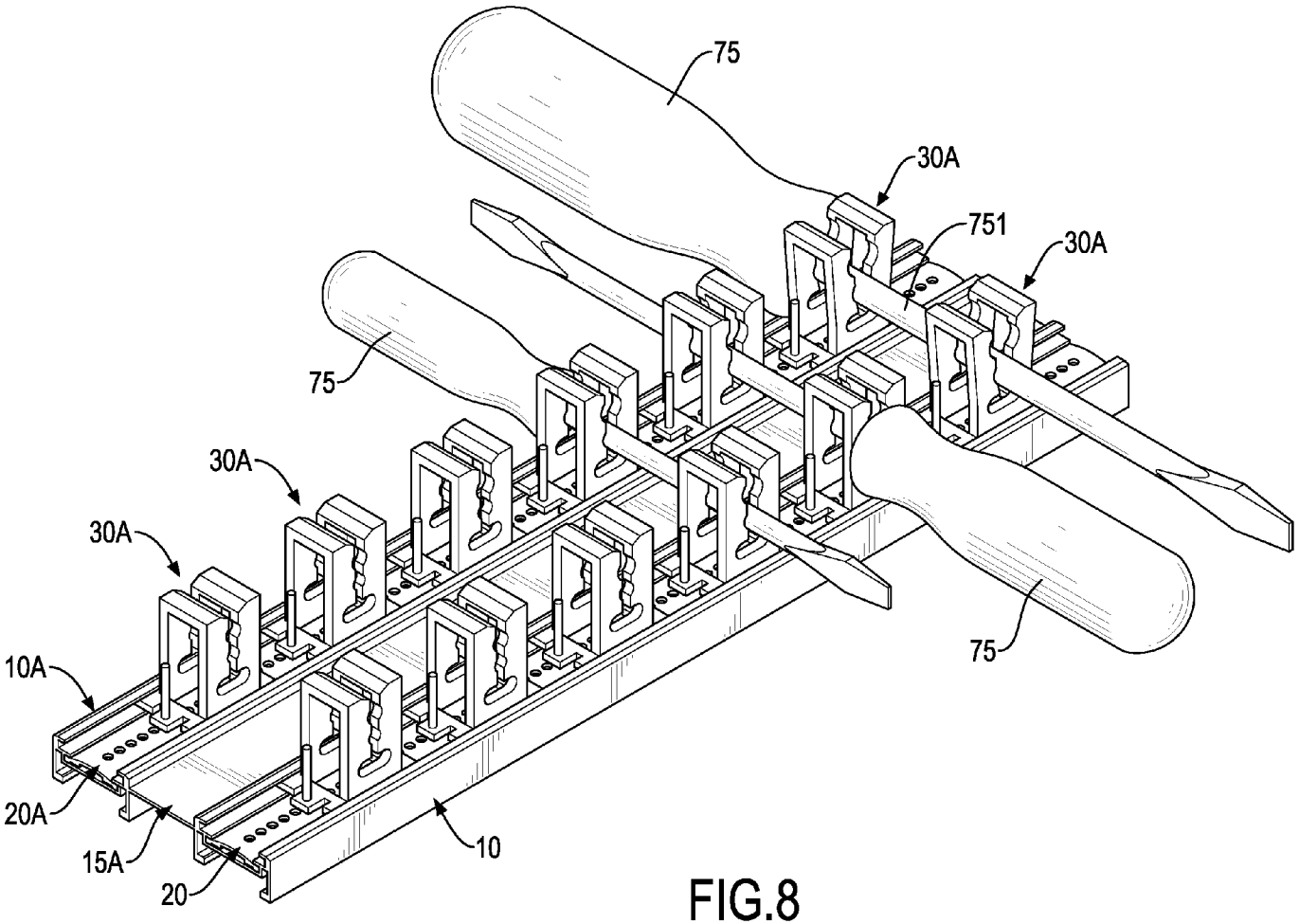
FIG. 8 is an enlarged operational perspective view of the hand tool frame in FIG. 5, shown with screwdrivers mounted on the hand tool frame.

Furthermore, in the second embodiment, the hand tool frame has at least one positioning mount 30A, and the at least one positioning mount 30A is mounted in the track base 10 or the extending track base 10A, and each one of the at least one positioning mount 30A has a sliding seat 31A, an extending element 32A, and a pressing arm 33A. The sliding seat 31A is slidably mounted in the track base 10 or the extending track base 10A. The extending element 32A is a hollow block, is formed on the top side of the sliding seat 31A, and has two sidewalls, a top side, at least one tool hole 322A, a tool slot 323A, and a mounting slit 324A. The at least one tool hole 323A is formed through the sidewalls of the extending element 32A to hold a shank 751 of a screwdriver 75 as shown in FIG. 8. The tool slot 323A is formed through the sidewalls of the extending element 32A and communicates with the at least one tool hole 322A. The mounting slit 324A is formed through the top side and the sidewalls of the extending element 32A and communicates with the at least one tool hole 322A opposite to the tool slot 323A.

Figure 7:
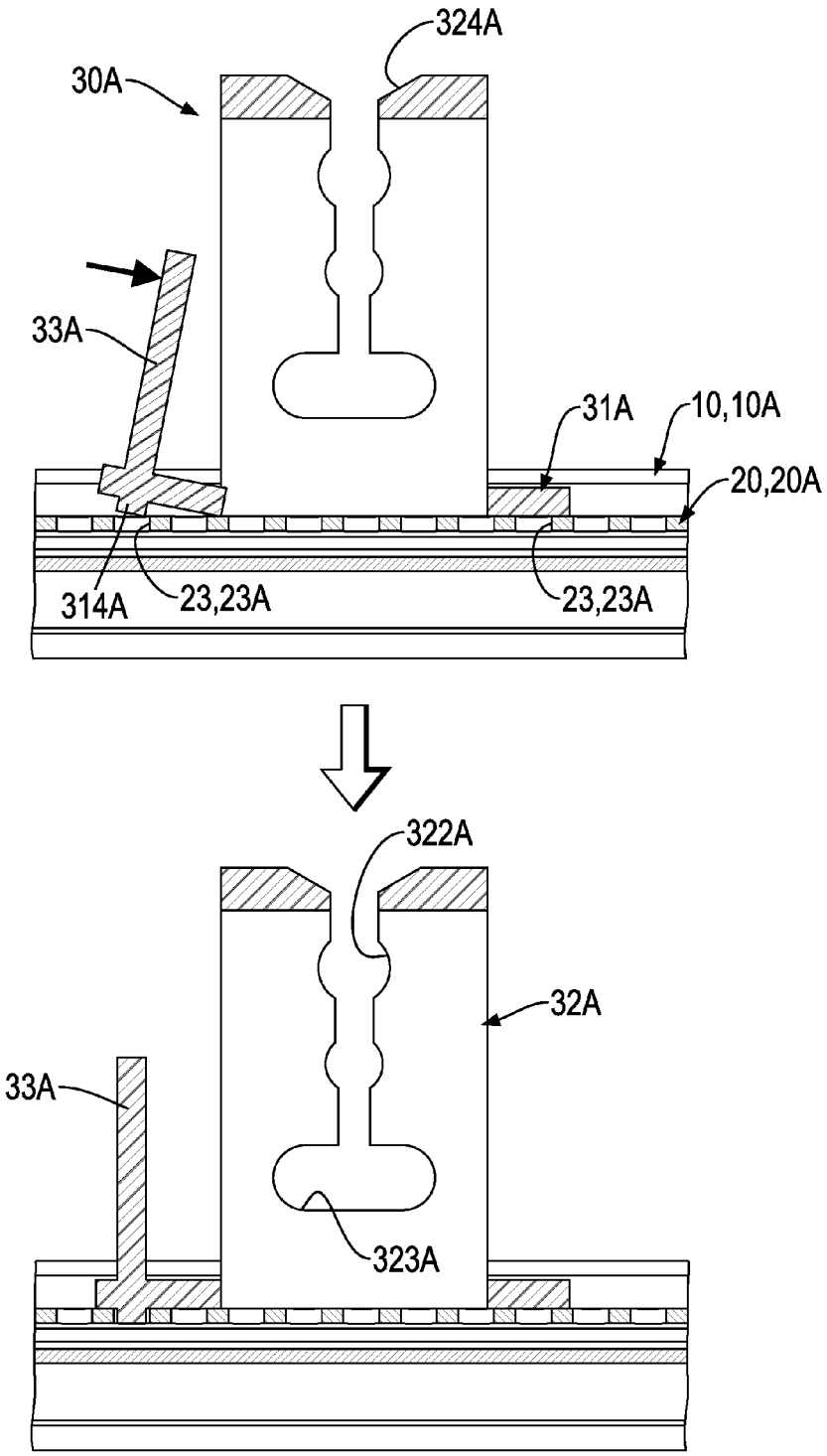
FIG. 7 is an operational and enlarged cross sectional side view of the hand tool frame in FIG. 5.

With reference to FIG. 7, when the hand tool frame of the second embodiment in the present invention is in use, two positioning mounts 30A that are respectively mounted in the track bases 10, 10A are respectively moved along the positioning board 20, 20A relative to the track base 10, 10A by pressing the pressing arms 33A to enable the engaging protrusions 314A to respectively disengage from two engaging holes 23, 23A of the positioning boards 20, 20A. When the two positioning mounts 30A respectively in the track bases 10, 10A align with each other, the user may release the pressing arms 33A of the two positioning mounts 30A to enable the engaging protrusions 314A to respectively engage two engaging holes 23, 23A of the positioning boards 20, 20A.

With reference to FIG. 8, a shank 751 of a screwdriver 75 is inserted into two positioning mounts 30A that are respectively mounted in the track bases 10, 10A via the mounting slits 324A of the extending elements 32A, and is held between two tool holes 323A of the extending elements 32A. Since the positioning mounts 30A are securely mounted on the track bases 10, 10A by the engagement between the positioning mounts 30A and the positioning boards 20, 20A, the screwdrivers 75 may be securely held on the track bases 10, 10A of the hand tool frame. Then, when the hand tool frame of the second embodiment in the present invention is moved or someone hits the hand tools that are stored on the track bases 10, 10A, the hand tools are still securely clamped between the positioning mounts 30A without changing positions or separating from the positioning mounts 30A. Then, the user doesn't need to adjust the positions of the hand tools after moving the hand tool frame, and the hand tools are securely clamped between the positioning mounts 30A and will not injure the users.

Figure 9:
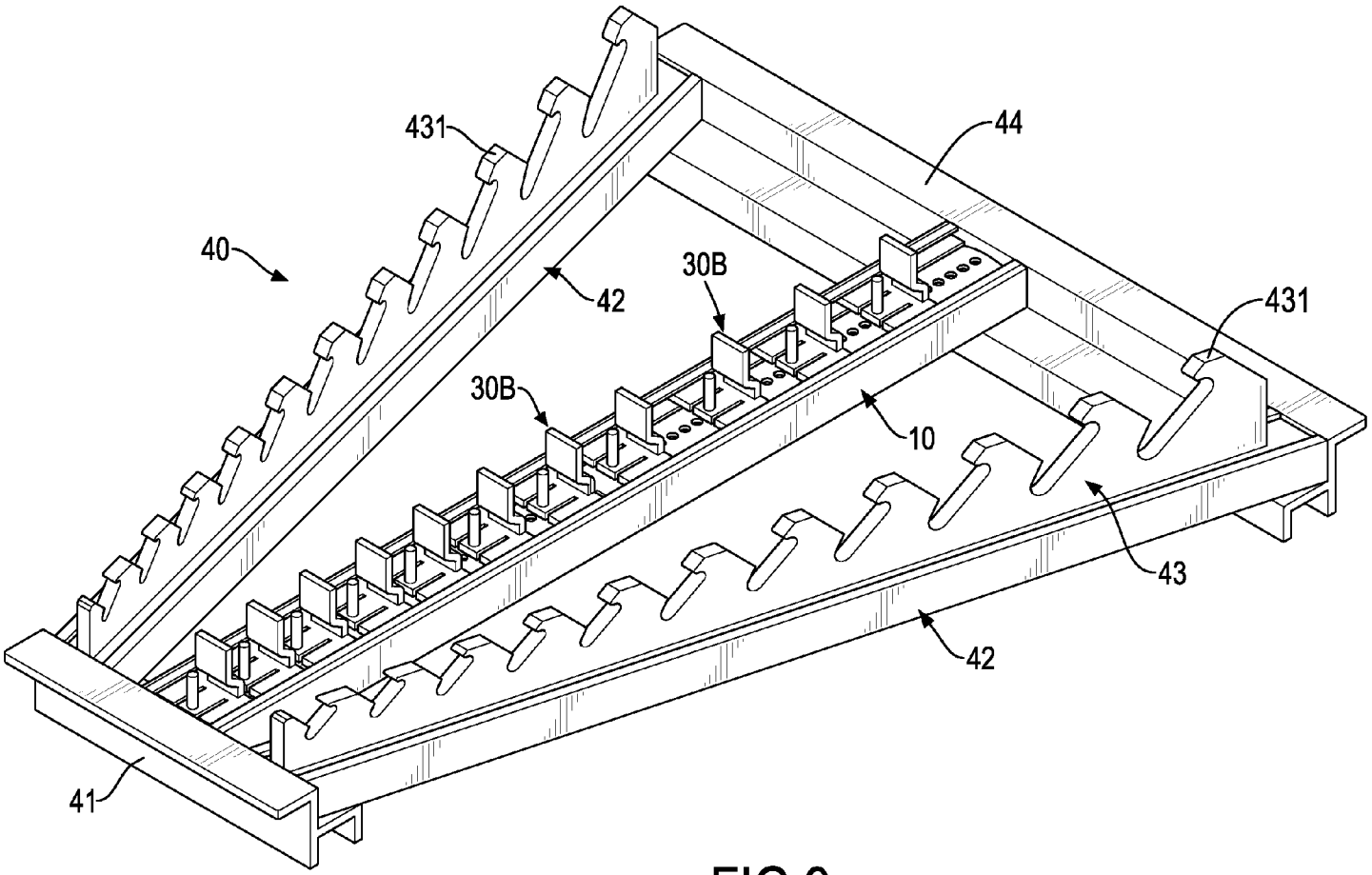
FIG. 9 is a perspective view of a third embodiment of a hand tool frame in accordance with the present invention.
Figure 10:
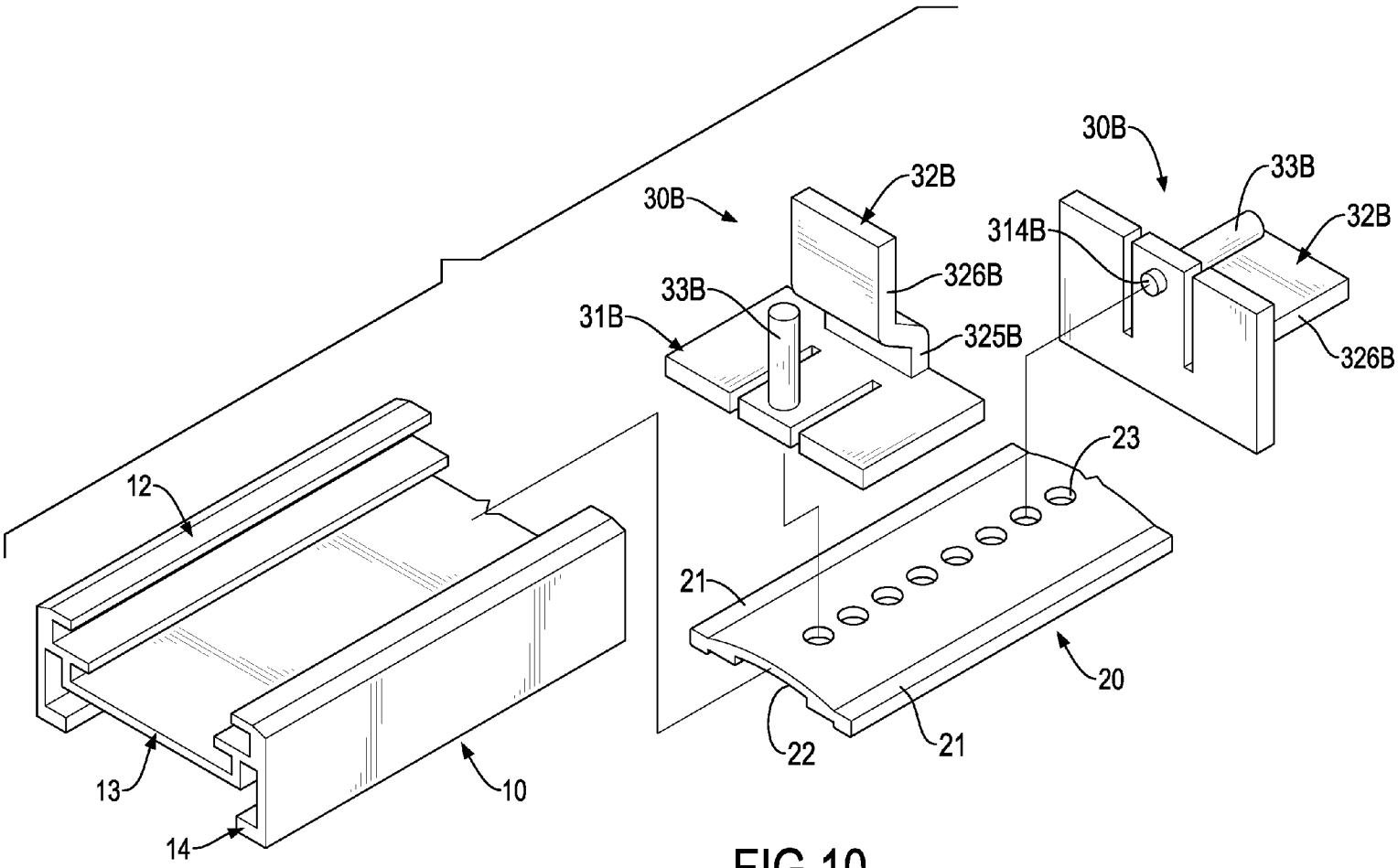
FIG. 10 is an enlarged and exploded perspective view of the hand tool frame in FIG. 9.

With reference to FIGS. 9 and 10, a third embodiment of a hand tool frame in accordance with the present invention is substantially the same as the first embodiment except for the following features. The hand tool frame further has an outer frame 40 connected to the track base 10 and having a first supporting mount 41, two side supporting racks 42, two clamping panels 43, and a second supporting mount 44.

The first supporting mount 41 is connected to the front end of the track base 10 to provide a holding effect to a user and has a length. The side supporting racks 42 are connected to the first supporting mount 41 beside the track base 10. The clamping panels 43 are respectively mounted in the side supporting racks 42, and each one of the clamping panels 43 has multiple clamping claws 431 continuously formed on a top side of the clamping panel 43 and extending out of a corresponding side supporting rack 42. The second supporting mount 44 is connected to the rear end of the track base 10, is connected to the side supporting racks 42, and has a length longer than the length of the first supporting mount 41. Then, the outer frame 40 is formed as a trapezoid frame by the supporting mounts 41, 44 and the side supporting racks 42.

The at least one positioning mount 30B is mounted in the track base 10, and each one of the at least one positioning mount 30B has a sliding seat 31B, an extending element 32B, and a pressing arm 33B. The sliding seat 31B is slidably mounted in the slide rail 12 of the track base 10. The extending element 32B is an elastic arm, is formed on the sliding seat 31B, and has a curved segment 325B and a limiting segment 326B. The curved segment 325B is curvedly formed on and protrudes from the sliding seat 31B and has a free end extending out of the slide rail 12. The limiting segment 326B is formed on and protrudes from the free end of the curved segment 325B of the extending element 32B to abut against a combination spanner 71 as shown in FIGS. 11 and 12.

Figure 11:
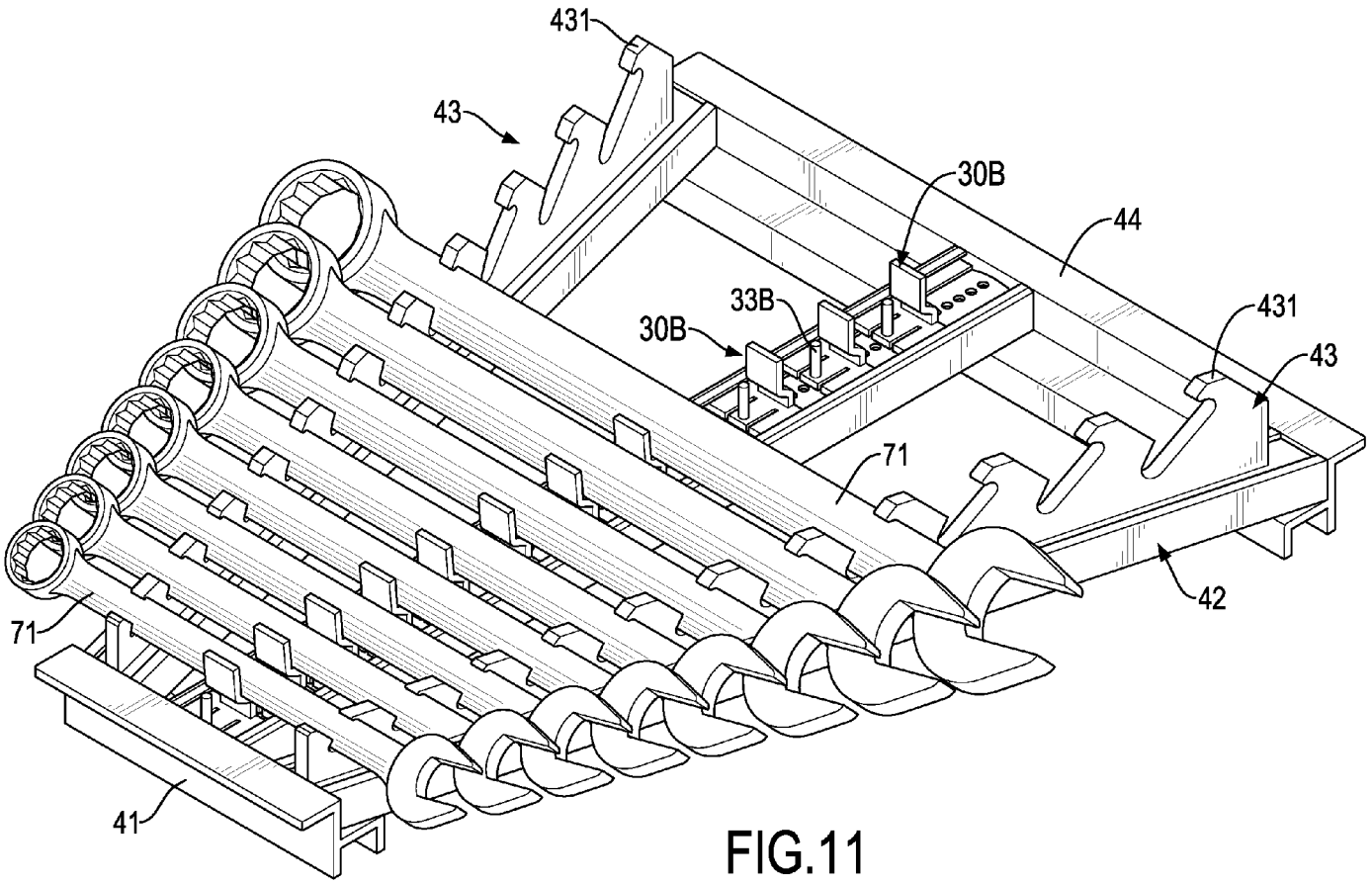
FIG. 11 is an operational perspective view of the hand tool frame in FIG. 9, shown with screwdrivers of different sizes mounted on the hand tool frame.
Figure 12:
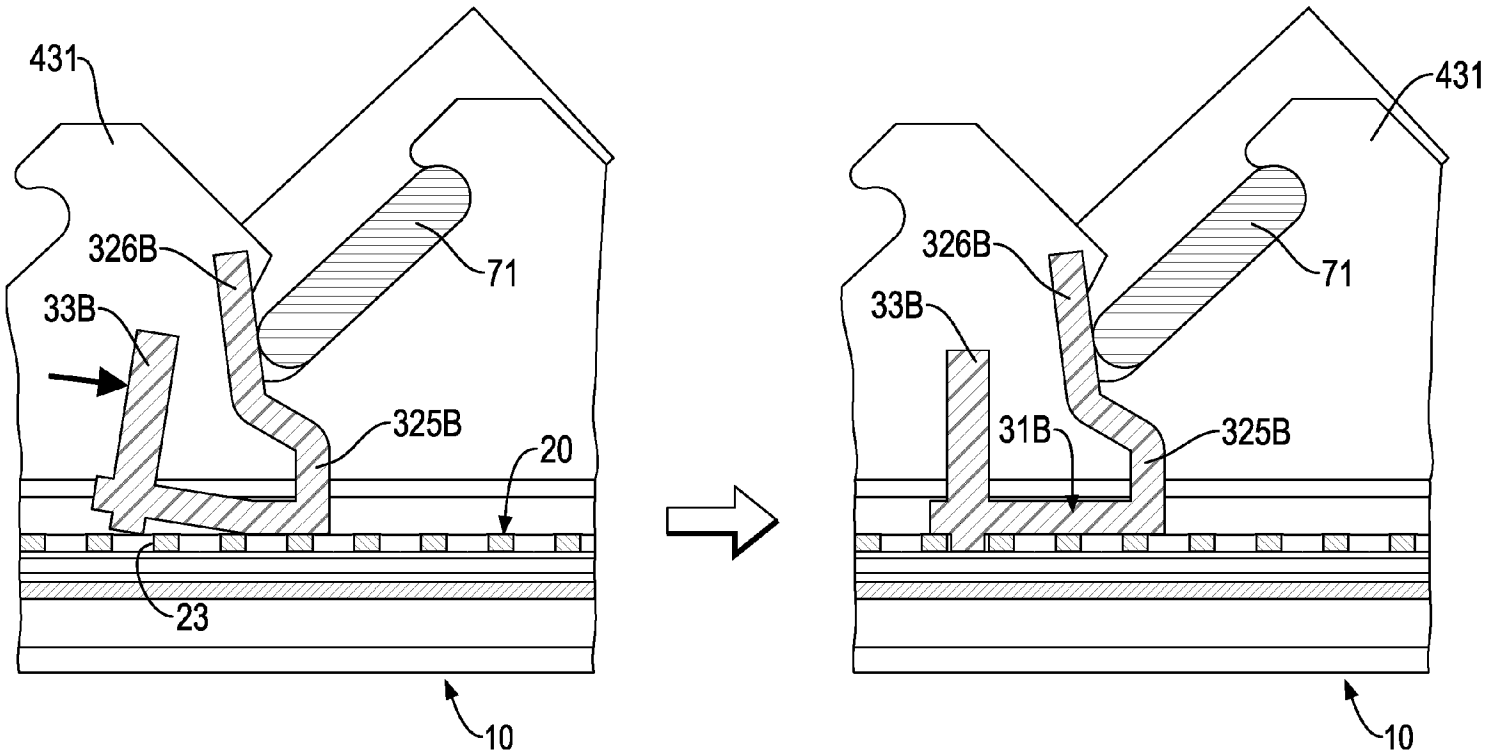
FIG. 12 is an operational and enlarged cross sectional side view of the hand tool frame in FIG. 11.

With reference to FIGS. 11 and 12, when combination spanners 71 of different sizes are mounted on the third embodiment of the hand tool frame, the combination spanners 71 are held in the clamping claws 431 of the clamping panels 43, and the position of the extending element 32B of each one of the positioning elements 30B may be adjusted by pressing the pressing arm 33B to release the engagement that is formed between the engaging protrusion 314B and a corresponding engaging hole 23 of the positioning board 20 and moving the positioning mounts 30B relative to the track base 10 to enable the limiting segment 326B of the extending element 32B to move close to and abut against a corresponding combination spanner 71. Furthermore, the curved segment 325B of the extending element 32B may be elastically deformed to closely abut against the corresponding combination spanner 71. Then, the combination spanners 71 of different sizes can be securely held on the hand tool frame between the clamping claws 431 of the clamping panels 43 and the positioning elements 30B. Therefore, when the hand tool frame of the third embodiment in the present invention is moved or someone hits the hand tools that are stored on the track base 10, the hand tools are still securely clamped between the positioning mounts 30B and the outer frame 40 without changing positions or separating from the positioning mounts 30B and the outer frame 40. Then, the user doesn't need to adjust the positions of the hand tools after moving the hand tool frame, and the hand tools are securely clamped between the positioning mounts 30B and the outer frame 40 and will not injure the users.

What is claimed is:

1. A hand tool frame comprising:

a track base being an elongated seat and having a bottom panel being elongated and having a top surface;

a bottom surface;

a front end; and a rear end; and a slide rail formed on and protruding from the top surface of the bottom panel between the front end and the rear end of the bottom panel and having a top side;

a top opening formed through the top side of the slide rail; and a sliding recess formed in the slide rail between the top side of the slide rail and the top surface of the bottom panel and communicating with the top opening;

a positioning board mounted in the track base and having two long opposite sides;

a front end;

a rear end;

a middle, and the positioning board bent forwardly from the long opposite sides of the positioning board to the middle of the positioning board;

a top surface, and the top surface of the positioning board extending toward the slide rail at the middle of the positioning board;

a bottom surface; and multiple engaging holes formed through the top surface and the bottom surface of the positioning board at the middle of the positioning board; and at least one positioning mount slidably mounted on the track base, and each one of the at least one positioning mount having a sliding seat slidably mounted in the sliding recess of the slide rail and abutting the positioning board, and having a body being U-shaped, slidably mounted in the sliding recess of the slide rail and having a bottom side abutting the top surface of the positioning board;

a top side facing the top opening of the slide rail;

two free ends; and a middle formed between the free ends of the body;

a positioning portion formed on and protruding transversally from the middle of the body and having a bottom surface abutting the top surface of the positioning board; and a top surface; and an engaging protrusion formed on and protruding downwardly from the bottom surface of the positioning portion, and selectively engaging with one of the engaging holes of the positioning board to enable the sliding seat to securely mount on the positioning board without sliding relative to the track base; and an extending element formed on and protruding upwardly from the sliding seat and extending out of the slide rail via the top opening to provide a tool-holding effect.

2. The hand tool frame as claimed in claim 1, wherein each one of the at least one positioning mount has a pressing arm formed on and protruding upwardly from the bottom side of the body of the sliding seat to enable the positioning portion to deform relative to the body and having an upper end extending out of the slide rail via the top opening.

3. The hand tool frame as claimed in claim 2, wherein each one of the at least one positioning mount has two through slots respectively formed through the body between the free ends of the body and the positioning portion to make the positioning portion elastomeric relative to the body.

4. The hand tool frame as claimed in claim 3, wherein the track base has a connecting track formed on and protruding from the bottom surface of the bottom panel, and having a top side formed on and protruding from the bottom surface of the bottom panel;

a communicating opening formed through the top side of the connecting track and the bottom surface of the bottom panel, and communicating with the sliding recess of the slide rail; and a connecting recess formed between the bottom panel and the connecting track and communicating with the communicating opening;

the positioning board is mounted in the connecting track of the track base and has two rail bars formed on and protruding downwardly from the bottom surface of the positioning board respectively at the two long opposite sides of the positioning board and mounted in the connecting recess of the connecting track; and a through recess formed in the bottom surface of the positioning board at the middle of the positioning board between the front end and the rear end of the positioning board, being parallel with the long opposite sides of the positioning board and communicating with the connecting recess of the connecting track;

wherein the engaging holes of the positioning board communicate with the connecting recess of the connecting track via the through recess and communicate with the sliding recess of the slide rail via the communicating opening of the connecting track; and the bottom side of the body of the sliding seat of each one of the at least one positioning mount faces the communicating opening of the connecting track.

5. The hand tool frame as claimed in claim 4, wherein the hand tool frame has at least one pair of positioning mounts; and the extending element of each one of the at least one pair of positioning mounts is a clamping arm, is formed on the top side of the body of the sliding seat and has a free end extending out of the slide rail via the top opening;

an inner side, and the inner sides of the extending elements of the at least one pair of positioning mounts facing to each other;

an outer side being opposite to the inner side of the extending element; and a holding hook formed on and protruding from the inner side of the extending element at the free end of the extending element, and the holding hooks of the at least one pair of positioning mounts facing to each other.

6. The hand tool frame as claimed in claim 4, wherein the hand tool frame further has an extending track base connected to and being parallel with the track base by an extending panel;

an additional positioning board mounted in the extending track base; and the at least one positioning mount is mounted in the track base or the extending track base.

7. The hand tool frame as claimed in claim 6, wherein the extending element of each one of the at least one positioning mount is a hollow block, is formed on the sliding seat, and has two sidewalls;

a top side;

at least one tool hole formed through the sidewalls of the extending element;

a tool slot formed through the sidewalls of the extending element and communicating with the at least one tool hole; and a mounting slit formed through the top side and the sidewalls of the extending element, communicating with the at least one tool hole, and being opposite to the tool slot.

8. The hand tool frame as claimed in claim 4, wherein the hand tool frame further has an outer frame connected to the track base and having a first supporting mount connected to the front end of the bottom panel of the track base to provide a holding effect to a user and having a length;

two side supporting racks connected to the first supporting mount beside the track base;

two clamping panels respectively mounted in the two side supporting racks, and each one of the clamping panels having multiple clamping claws continuously formed on a top side of the clamping panel and extending out of a corresponding side supporting rack; and a second supporting mount connected to the rear end of the bottom panel of the track base, connected to the side supporting racks, and having a length longer than the length of the first supporting mount to form a trapezoid shape of the outer frame between the supporting mounts and the side supporting racks.

9. The hand tool frame as claimed in claim 8, wherein the extending element of each one of the at least one positioning mount is an elastic arm, is formed on the sliding seat, and has a curved segment curvedly formed on and protruding from the sliding seat and having a free end extending out of the slide rail; and a limiting segment formed on and protruding from the free end of the curved segment of the extending element.

10. The hand tool frame as claimed in claim 4, wherein the track base has a closed track formed on and protruding downwardly from the bottom surface of the bottom panel around the connecting track and having a bottom side and a bottom opening formed through the bottom side of the closed track.

* * * * *